US010330315B2

(12) United States Patent
Bowser, Jr. et al.

(10) Patent No.: US 10,330,315 B2
(45) Date of Patent: Jun. 25, 2019

(54) INTEGRAL SELF-SUPPORTING COMPOSITE REFRACTORY WALL MODULES FOR REFRACTORY STRUCTURES AND METHODS OF FORMING REFRACTORY STRUCTURE WALLS OF THE SAME

(71) Applicant: FOSBEL, INC., Brook Park, OH (US)

(72) Inventors: Alan E. Bowser, Jr., Brook Park, OH (US); Michael Smith, Brook Park, OH (US); Lou Carolla, Brook Park, OH (US)

(73) Assignee: FOSBEL, INC., Brook Park, OH (US)

( * ) Notice: Subject to any disclaimer, the term of this patent is extended or adjusted under 35 U.S.C. 154(b) by 551 days.

(21) Appl. No.: 15/013,229

(22) Filed: Feb. 2, 2016

(65) Prior Publication Data

US 2016/0223197 A1 Aug. 4, 2016

Related U.S. Application Data

(60) Provisional application No. 62/111,447, filed on Feb. 3, 2015.

(30) Foreign Application Priority Data

Feb. 25, 2015 (GB) ..... 1503129.7

(51) Int. Cl.

| | |
|---|---|
| ***F23M 5/02*** | (2006.01) |
| ***F27D 1/04*** | (2006.01) |
| ***C10B 29/02*** | (2006.01) |
| ***E04B 2/02*** | (2006.01) |
| ***F27D 1/14*** | (2006.01) |
| ***F27D 1/06*** | (2006.01) |

(Continued)

(52) U.S. Cl.

CPC ..... *F23M 5/02* (2013.01); *C10B 29/02* (2013.01); *E04B 2/02* (2013.01); *F23M 5/06* (2013.01); *F27D 1/027* (2013.01); *F27D 1/04* (2013.01); *F27D 1/063* (2013.01); *F27D 1/14* (2013.01); *E04B 2002/0202* (2013.01)

(58) Field of Classification Search

CPC .. F23M 5/02; F27D 1/04; F27D 1/063; F27D 1/06; E04B 2/02; E04B 2002/0202; E04B 2002/0204; E04B 2002/0206; E04B 2002/0208; E04B 2002/0226

See application file for complete search history.

(56) References Cited

U.S. PATENT DOCUMENTS

2006/0272264 A1 12/2006 Parker

FOREIGN PATENT DOCUMENTS

| | | |
|---|---|---|
| GB | 736104 | 8/1955 |
| GB | 945640 | 1/1964 |
| GB | 938363 | 10/1965 |

(Continued)

OTHER PUBLICATIONS

International Search Report and Written Opinion, PCT/US2016/016064, dated Apr. 4, 2016.

(Continued)

*Primary Examiner* — David J Laux
(74) *Attorney, Agent, or Firm* — Nixon & Vanderhye P.C.

(57) ABSTRACT

Refractory modules are provided by multiple preformed refractory blocks bonded to one another by a bonding agent to form an integral self-supporting structure having a tooth and channel arrangement for interlocking assembly with a similar adjacently positioned refractory module.

12 Claims, 6 Drawing Sheets

(51) Int. Cl.
*F27D 1/02* (2006.01)
*F23M 5/06* (2006.01)

(56) References Cited

FOREIGN PATENT DOCUMENTS

| | | |
|---|---|---|
| GB | 1 386 898 | 3/1975 |
| JP | 2007-263447 | 10/2007 |

OTHER PUBLICATIONS

Search Report for GB1503129.7 dated Jul. 29, 2015, two (2) pages.

INTEGRAL SELF-SUPPORTING COMPOSITE REFRACTORY WALL MODULES FOR REFRACTORY STRUCTURES AND METHODS OF FORMING REFRACTORY STRUCTURE WALLS OF THE SAME

CROSS-REFERENCE TO RELATED APPLICATIONS

This application is based on and claims domestic priority benefits under 35 USC § 119(e) from U.S. Provisional Application Ser. Nos. 62/111,447 filed on Feb. 3, 2015 and also claims foreign priority benefits under 35 USC § 119(a) from GB 1503129.7 filed on Feb. 25, 2015, the entire contents of each such prior filed application being expressly incorporated hereinto by reference.

FIELD

The embodiments disclosed herein relate generally to integral self-supporting composite refractory modules that may be assembled to form a wall of a refractory structure. According to some embodiments, the modules are formed of multiple refractory blocks integrally bonded together to provide the integral self-supporting composite refractory module. The modules may be assembled in interlocking relationship with one another to form a refractory wall structure.

BACKGROUND

Several industries employ relatively massive refractory structures formed of refractory bricks of varying sizes and shapes. For example, coke ovens and glass furnaces, including regenerators associated with such furnaces, traditionally comprise massive refractory brick structures having relatively large-scale parallel walls, crown arches and floor arches (typically termed rider arches in art parlance) constructed from a large variety of differently shaped individual refractory bricks. The construction and repair of such refractory structures can be extremely tedious and time consuming due to the individual refractory brick construction thereby resulting in costly downtime and a concomitant economic loss.

Recently, it has been proposed to provide relatively monolithic refractory components to reduce the number of individual bricks forming the refractory structures and thereby reduce the downtime required to construct and/or repair the refractory structure. See in this regard, U.S. Pat. Nos. 8,640,635, 8,266,853 and 6,066,236 and copending U.S. Provisional Patent Application Ser. No. 62/111,390 filed Feb. 3, 2015, the entire contents of each such patent and pending patent application being expressly incorporated hereinto by reference.

While these prior proposals are satisfactory, continual improvement in the construction and repair/servicing of relatively massive refractory structures (e.g., coke ovens, glass furnaces, forehearths, regenerators and the like) is sought. For example, it would be desirable if integral self-supporting refractory modules could be formed from multiple refractory blocks so that the individual refractory modules could be formed remotely and then transported to the point of use for installation where they could be interlocked together to form the refractory wall structure. This off-site fabrication of the refractory module could in turn produce extensive labor cost savings since individual wall blocks would not need to be assembled on site. It is towards providing such improvement that the embodiments of the invention described herein are directed.

SUMMARY

In general, the embodiments disclosed herein are directed toward composite refractory modules comprising multiple preformed refractory blocks bonded to one another by a bonding agent to form an integral self-supporting structure having a tooth and channel arrangement for interlocking assembly with a similar adjacently positioned refractory module. According to certain embodiment, the pre-formed refractory blocks are substantially square parallelepipeds formed of a cured refractory material which may be pressed or cast. At least three preformed refractory blocks are bonded to one another in some embodiments to form the module.

The bonding agent which bonds the multiple refractory members to one another may either be a sacrificial or non-sacrificial bonding agent. According to some embodiments, the bonding agent is a high temperature epoxy adhesive bonding agent.

A refractory wall section comprising a stacked and end-to-end assembly of plural interlocked refractory modules may thereby be formed. That is, a refractory wall section of a refractory structure can be formed by assembling end-to-end and stacking a plurality of refractory modules such that the tooth of one module is received within and interlocked with the channel of an adjacent module.

These and other aspects and advantages of the present invention will become more clear after careful consideration is given to the following detailed description of the preferred exemplary embodiments thereof.

BRIEF DESCRIPTION OF ACCOMPANYING DRAWINGS

The disclosed embodiments of the present invention will be better and more completely understood by referring to the following detailed description of exemplary non-limiting illustrative embodiments in conjunction with the drawings of which:

Figure 1:
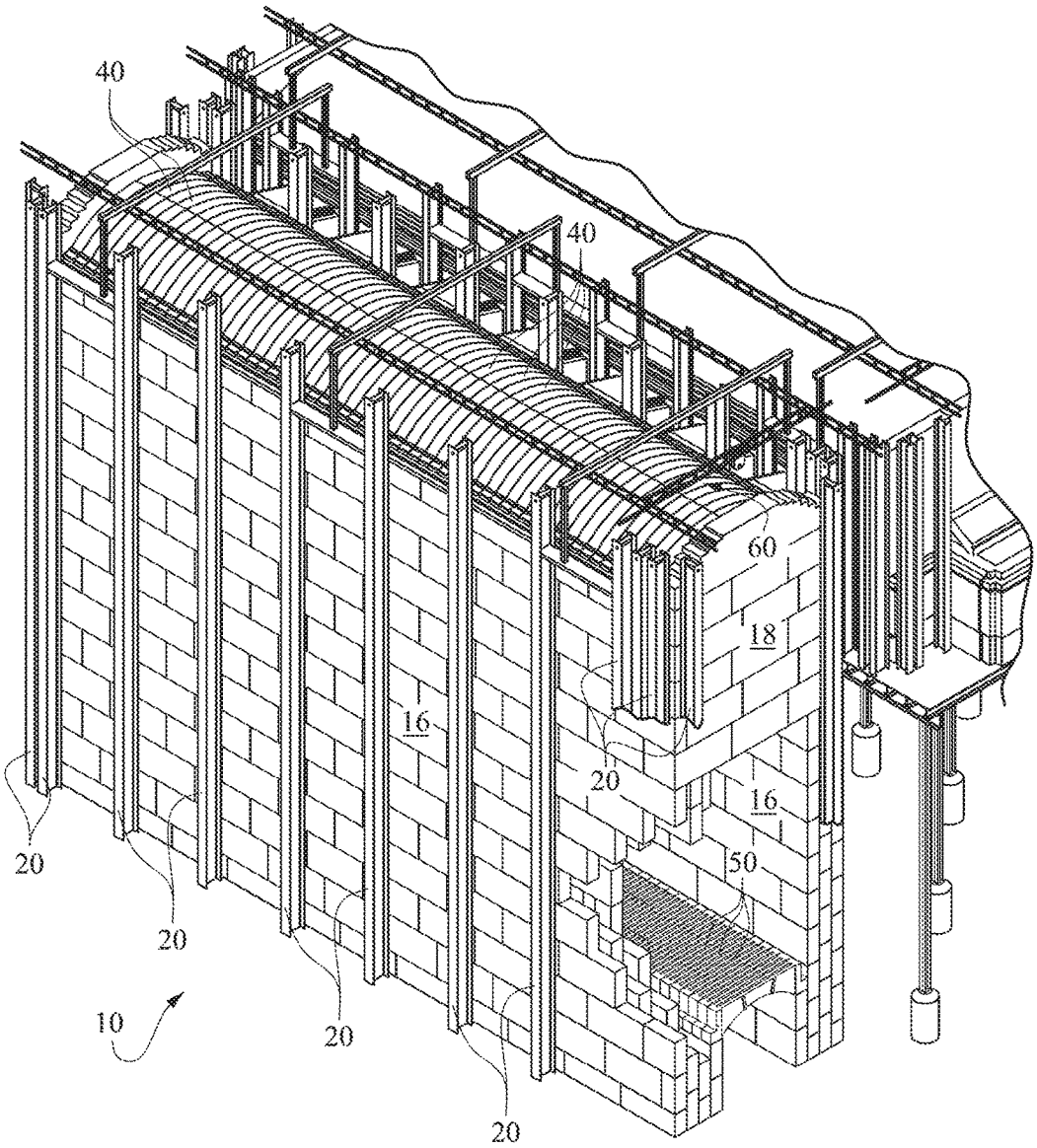
FIG. 1 is a perspective view of a glass furnace regenerator structure with a wall thereof partly exposed showing an assembly of refractory modules in accordance with embodiments of the present invention.
Figure 2:
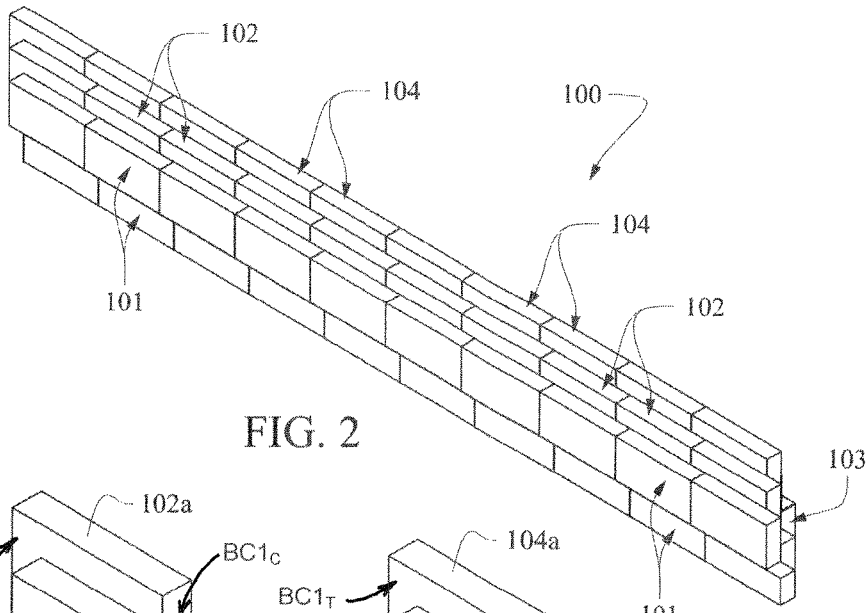
FIG. 2 is a front perspective view of a refractory foundation wall section formed of refractory modules according to an embodiment of the invention that may be employed in the glass furnace regenerator structure depicted in FIG. 1.
Figure 2A:
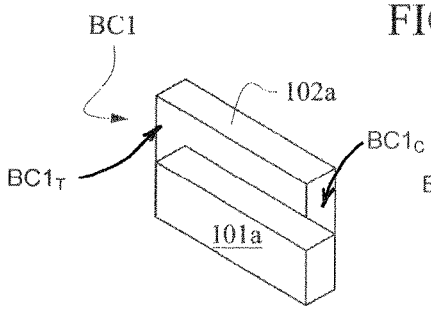
Figure 2B:
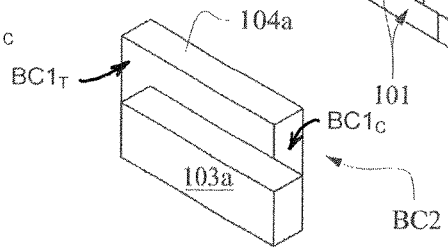
Figure 2C:
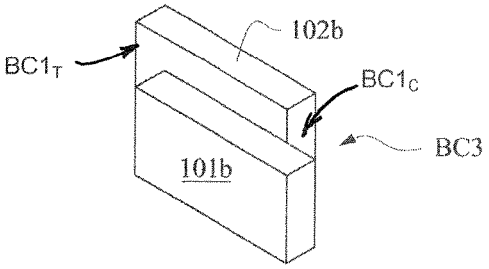
Figure 2D:
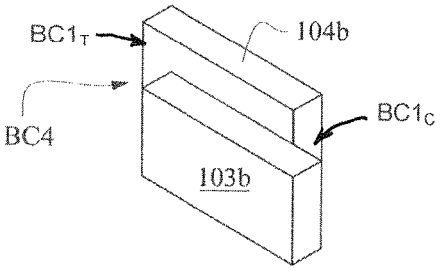
Figure 2E:
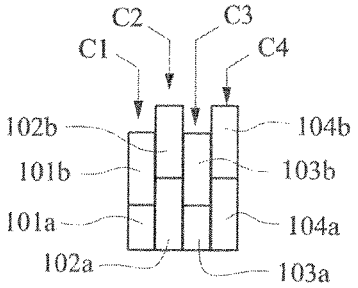
Figure 2F:
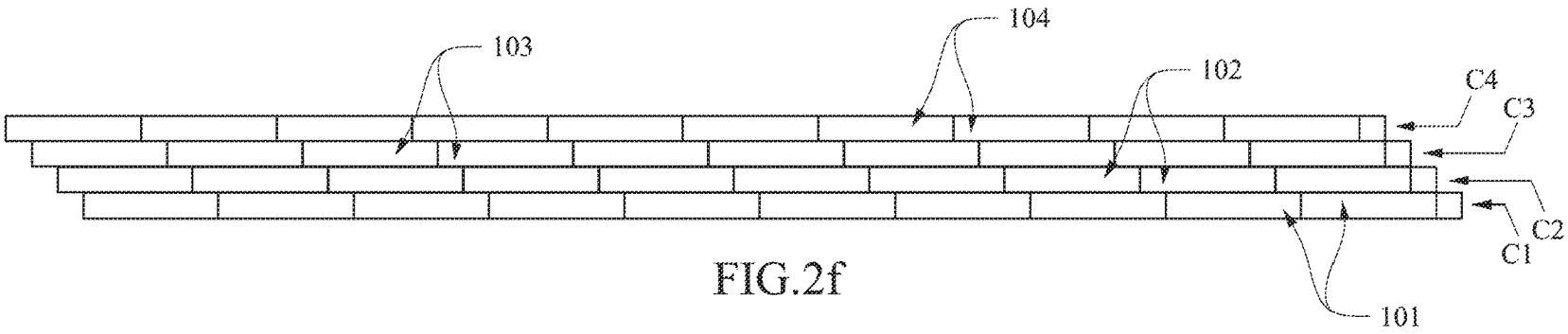
Figure 2G:
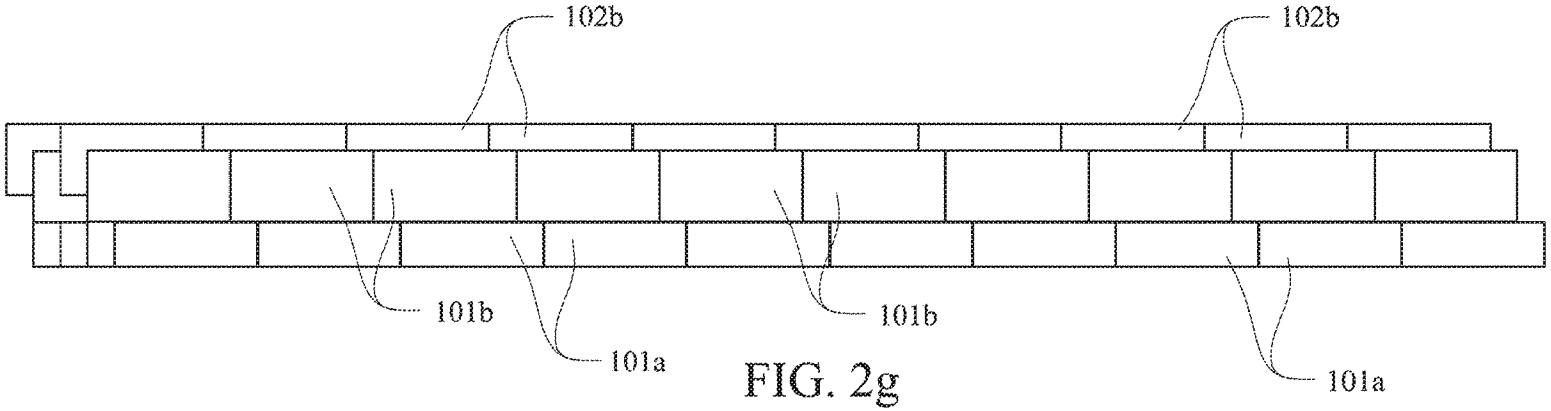
Figure 3:
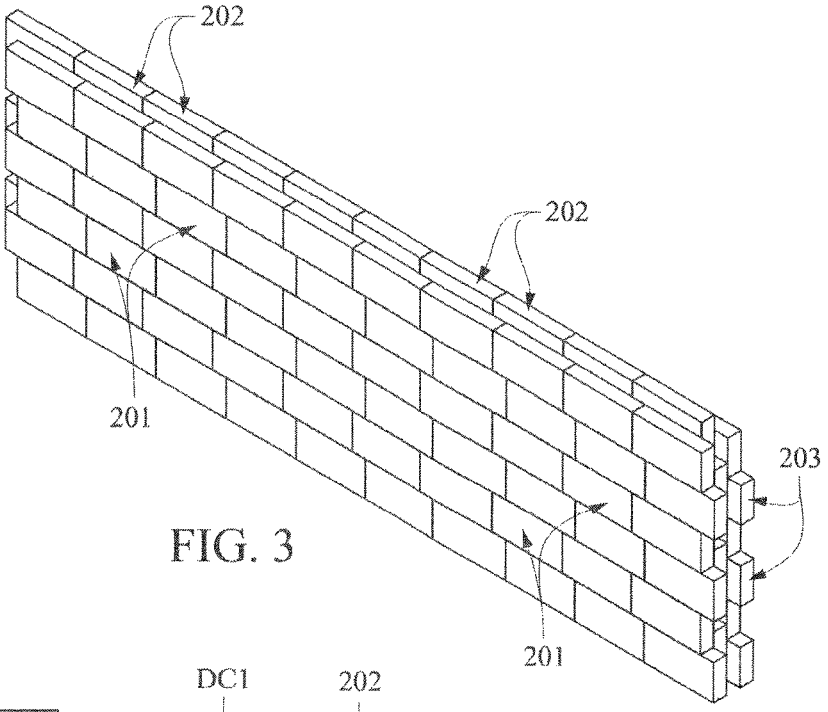
Figure 3A:
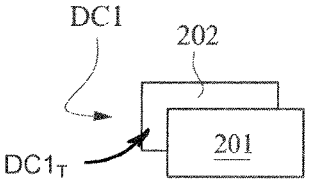
Figure 3B:
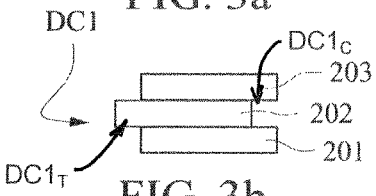
Figure 3C:
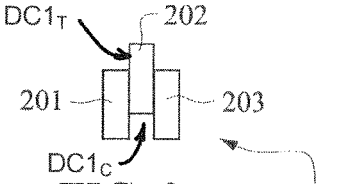
Figure 3D:
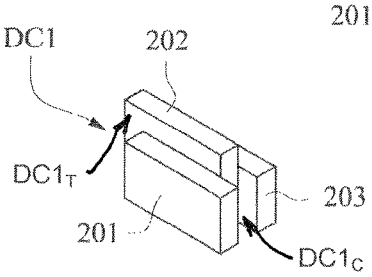
Figure 3E:
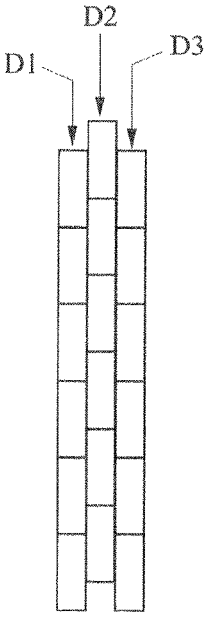
Figure 4:
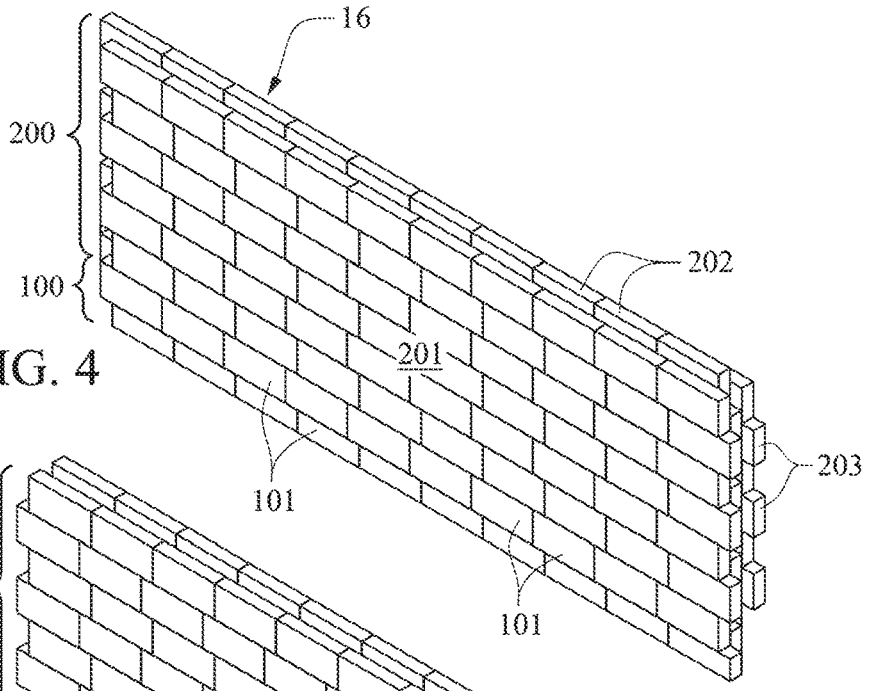
Figure 5:
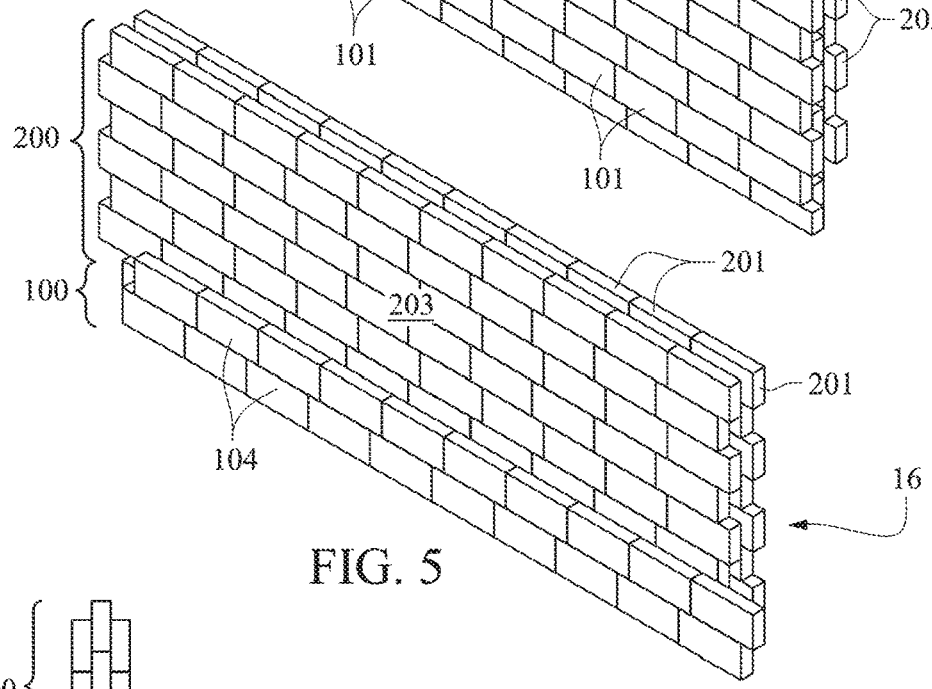
Figure 6:
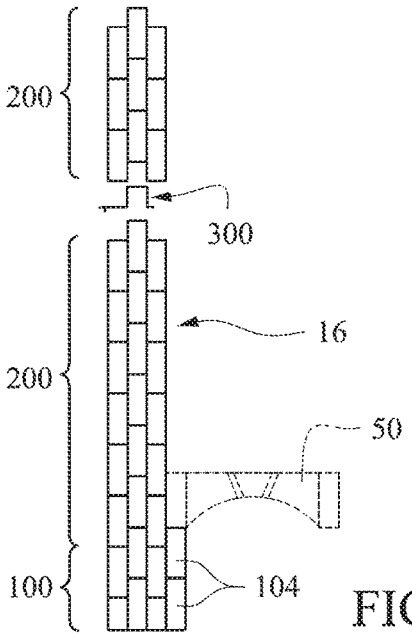
Figure 7:
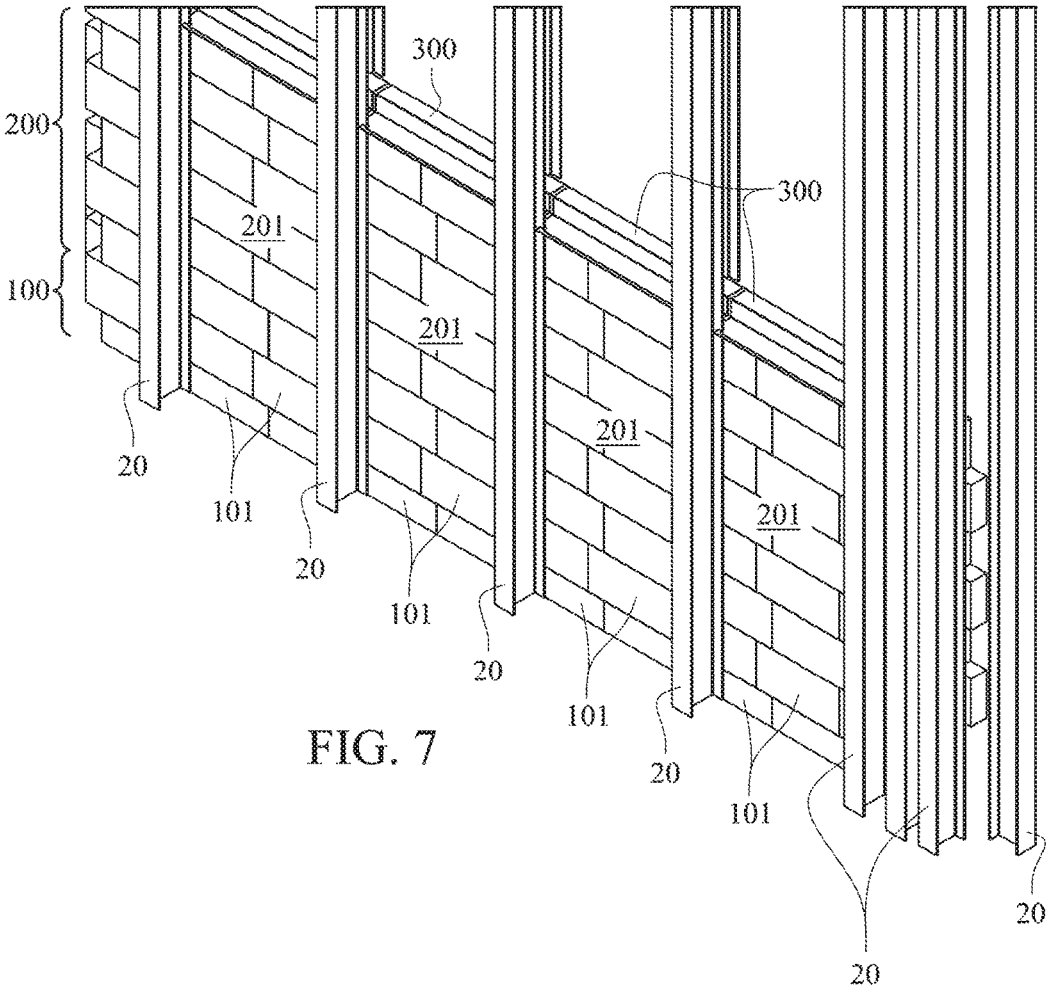

FIGS. 2*a*-2*d* are respective refractory base block modules that may be assembled to form the foundation wall section depicted in FIG. 2;

FIG. 2*e*-2*g* are end elevation, top plan and side elevation views, respectively, of the base refractory wall section depicted in FIG. 2;

FIG. 3 is a front perspective view of a refractory wall riser section that may be interconnected one another and with the base wall section of FIG. 2 to form a wall of the glass furnace regenerator structure depicted in FIG. 1;

FIGS. 3*a*-3*d* are side elevation, top plan, end elevation and front perspective views, respectively, of a refractory riser block module that may be assembled to form the riser wall section depicted in FIG. 3;

FIG. 3*e* is an end elevation view of the riser wall section depicted in FIG. 3;

FIG. 4 is an exterior perspective view of refractory wall having the wall sections depicted in FIGS. 2 and 3 assembled in interlocking relationship with one another;

FIG. 5 is an interior perspective view of the refractory wall depicted in FIG. 4; and FIG. 6 is a partly exploded end elevation view of the refractory wall shown in FIG. 4; and FIG. 7 is a perspective view showing the refractory wall shown in FIG. 4 assembled with buck stays associated with a refractory structure.

DETAILED DESCRIPTION

Accompanying FIG. 1 schematically depicts a perspective view of a regenerator structure 10 constructed of integral self-supporting composite refractory modules to be described in greater detail below that may be assembled to form side and/or end walls 16, 18 thereof. It will be appreciated that the regenerator structure 10 is used in operative combination with a glass furnace (not shown). The regenerator structure 10 generally depicted in the accompanying FIG. 1 is of a type used for side-fired glass furnaces. However, the attributes of the embodiments of the invention to be described herein are equally applicable to other glass furnace designs, e.g. end-fired glass furnaces, as well as to other refractory structures that may benefit from the advantages of the embodiments of the invention (e.g., coke ovens).

The top portion of the regenerator structure 10 is capped with a series of adjacently positioned crowns (a representative few of which are noted by reference numeral 40). The walls 16, 18 are structurally supported by external upright structural beams known colloquially as buck stays 20. As is known in the art, the buck stays 20 are compressively held against the walls 16, 18 by means of tie rods (not shown) extending between and interconnecting opposed pairs of buck stays 20 both latitudinally and longitudinally relative to the regenerator structure 10.

The bottom portion of the regenerator structure includes adjacently positioned rider arches 50. The rider arches 50 are thus provided to provide a channel for the ingress/egress of combustion air and gases to/from the regenerator structure 10 and to provide a supporting floor for the checker bricks (not shown) occupying the interior volume of the regenerator structure 10 thereabove.

The crown arches 40 and the rider arches 50 may be those as described in copending U.S. Provisional Patent Application Ser. No. 62/079,735 filed on Nov. 14, 2014, the entire content of which is expressly incorporated hereinto by reference.

The refractory structure may be provided with an overhead crane apparatus 60 to position and assemble the modules forming the walls 16, 18 as well as the crown arches 40, the rider arches 50 and the internal checker bricks (not shown) during construction and/or refurbishment of the regenerator 10. The overhead crane apparatus 60 may be those described more fully in U.S. Provisional Patent Application Ser. Nos. 62/111,275, 62/111,398 and 62/111,24 each filed on Feb. 3, 2015, the entire contents of each such application being expressly incorporated hereinto by reference.

Accompanying FIG. 2 depicts an embodiment of a refractory foundation wall section 100 which is formed of refractory modules according to an embodiment of the invention to be discussed below that may be employed to form a wall 16, 18 of the glass furnace regenerator structure 10 depicted in FIG. 1. As shown, the foundation wall section 100 is comprised of multiple vertically oriented stacks identified as C1-C4 in FIG. 2. Each of the stacks C1-C4 is comprised of multiple individual precast refractory blocks (a representative few of which are identified in FIG. 2 by reference numerals 101, 102, 103 and 104, respectively). Pairs of the individual precast refractory blocks 101, 102, 103 and 104, respectively, may be pre-bonded by a suitable bonding agent (e.g., an epoxy adhesive bonding agent) to form integral self-supporting refractory foundation block modules BC1-BC4 as shown in FIGS. 2*a*-2*d*, respectively. Thus, block modules BC1-BC4 will be formed of a bonded pair of precast refractory blocks 101*a*/102*a*, 103*a*/104*a*, 101*b*/102*b* and 103/*b*/104*b*, respectively.

These pre-assembled refractory block modules BC1-BC4 may then be further assembled either off-site or on-site with one another to form the base wall 100. That is, it will be seen that each of the block pairs 101*a*/102*a*, 103*a*/104*a*, 101*b*/102*b* and 103*b*/104*b* forming the block components BC1-BC4 are staggered and/or differently sized so as to establish a tooth and channel arrangement to allow the modules BC1-BC4 to be assembled so that a respective tooth $BC1_T$-$BT4_T$ of one of the modules BC1-BC4 is received within a respective channel $BC1_C$-$BC4_C$ of an adjacent one of the modules BC1-BC4, respectively.

Accompanying FIG. 3 depicts a front perspective view of a refractory riser wall section 200 that may be interconnected with the foundation wall section 100 to form a wall 16, 18 of the glass furnace regenerator structure 10 depicted in FIG. 1. The riser wall section 200 includes multiple vertically oriented stacks identified as D1-D3 in FIG. 3*e*. Each of the stacks D1-D3 is comprised of multiple individual precast refractory blocks (a representative few of which are identified in FIG. 3 by reference numerals 201, 202 and 203, respectively). In this regard, the individual precast refractory blocks 201, 202 and 203, respectively, may be pre-bonded by a suitable bonding agent (e.g., an epoxy adhesive bonding agent) to form a refractory riser block module DC1 as shown in FIGS. 3*a*-3*d*. Thus, riser block module DC1 will be formed of a bonded set of precast refractory blocks 201/202/203 in a staggered relationship as shown to establish a tooth and channel arrangement. By stacking and assembling end-to-end a number of the block modules DC1, a respective tooth $DC1_T$ of one of the modules DC1 will be received within a respective channel $DC1_C$ of an adjacent module DC1.

The modules BC1-BC4 and DC1 forming the base and riser wall sections 100, 200, may be interlocked with one another as described previously to form a wall 16,18 of the refractory structure 10. FIGS. 4-7 thus depict an assembly of the base and rise wall sections 100, 200 forming a side wall 16 of the refractory structure 10. It will be appreciated that the modules BC1-BC4 and/or DC1 as described previously could be assembled to form an end wall 18 of the refractory structure 10. In this regard, when employed as a side wall 16 of the refractory structure, the refractory blocks 104 will form a pedestal support for the rider arch 50 as shown, e.g., by FIG. 6. Thus, when forming an end wall 18 of the refractory structure 10, such a pedestal support would not be required, in which case the modules DC1 may be stacked and/or assembled end-to-end in interlocking relationship as may be needed.

In order to improve the structural integrity of the wall 16, a profiled tie plate 300 may be positioned as desired intervals over an upper edge of the assembled modules DC1 as shown in FIG. 7 so as to structurally interconnect a course of the modules DC1 with the buck stays 20.

As used herein and in the accompanying claims, the term term "block" is intended to refer to a generally large sized solid refractory member that requires mechanical assistance for handling and manipulation (e.g., via suitable hoists, lifts and the like). More specifically, a "block" as used herein and the accompanying claims is intended to refer to a refractory member whose weight cannot be lifted manually by a single individual in accordance with generally accepted guidelines according to the US Occupational Safety and Health Administration (OSHA), e.g., typically an object which weighs more than about 50 pounds. Conversely, as used herein and in the amended claims, the term "brick" refers to a generally small sized solid refractory member that may easily be handled and manipulated by a single individual in accordance with the generally accepted OSHA guidelines, e.g., typically an object weight less than about 50 pounds.

The refractory "block" employed by the embodiments disclosed herein are most preferably formed of a refractory material (e.g., fused silica) that is mechanically pressed and cured at high temperatures (e.g., up to about 1400° C.) as described, for example, in U.S. Pat. Nos. 2,599,236, 2,802,749 and 2,872,328, the entire contents of each such patent being expressly incorporated hereinto by reference. If the refractory "block" is of an exceptionally large size, it may be formed by casting and heat curing a refractory material (e.g., fused silica) as described in U.S. Pat. Nos. 5,277,106 and 5,423,152, the entire contents of each such patent being expressly incorporated hereinto by reference.

The refractory blocks forming each of the modules BC1-BC4 and DC1 as described above may be formed of the same or different refractory material. In this regard, the individual blocks forming each of the courses in the module may be formed of a different refractory material so that the thermal properties of the refractory walls 16 and/or 18 can be engineered to meet the heat-transfer requirements of the refractory structure 10. Additionally or alternatively, the refractory material forming the individual refractory blocks of the modules BC1-BC4 and DC1 may be selected such that the refractory walls 16 and/or 18 exhibit different heat-transfer properties at different vertical locations.

According to the embodiments disclosed herein, the blocks forming the modules BC1-BC4 and DC1 are preferably bonded to one another by a suitable sacrificial or non-sacrificial bonding agent, such as an epoxy adhesive bonding agent. By the term "sacrificial bonding agent" is meant to refer to bonding agents that allow the refractory blocks to be bonded to one another to form an integral self-supporting transportable refractory module, but which are consumed or combusted in the high heat (e.g., temperatures of about 1100° C. to about 1650° C.) during use of the refractory structure 10 in which the component is installed. The individual blocks forming the refractory modules will remain intact when the sacrificial bonding agent is consumed or combusted by virtue of the refractory module design and the structural support provided by other refractory interlocked therewith to form the complete refractory structure. By the term "non-sacrificial bonding agent" is meant a bonding agent that remains intact and is not consumed or combusted at the high temperatures associated with the refractory structure in which the refractory module is installed.

As noted above the preferred bonding agent is an epoxy adhesive bonding agent. As noted previously, the epoxy bonding agent may be sacrificial or non-sacrificial.

The blocks forming the modules BC1-BC4 and DC1 may be the same or different from one another in terms of refractory composition. In such a manner, therefore, the modules BC1-BC4 and DC1 may be designed to have different thermal transfer properties and assembled in such a manner so that the thermal transfer properties vary from one location of the refractory wall to another location. In such a manner, therefore, those regions of the refractory wall requiring greater or lesser thermal transfer properties may be provided by suitable compositions of the assembled individual refractory blocks.

It will be understood that the description provided herein is presently considered to be the most practical and preferred embodiments of the invention. Thus, the invention is not to be limited to the disclosed embodiments, but on the contrary, is intended to cover various modifications and equivalent arrangements included within the spirit and scope thereof.

What is claimed is:

1. A refractory structure comprising:

opposed pairs of side and end walls, wherein the side and end walls comprise a plurality of interconnected integral self-supporting riser wall sections, wherein each riser wall section comprises a plurality of end-to-end interconnected refractory modules which include multiple preformed square parallelepiped refractory blocks bonded to one another by a bonding agent to form the integral self-supporting riser wall sections, wherein the refractory blocks of each refractory module are off-set relative to one another so as to establish respective tooth and channel arrangements at opposed ends of the refractory module, wherein the tooth and channel arrangements of one of the refractory modules being interlocked with respective channel and tooth arrangements of other refractory modules adjacently end-to-end interconnected therewith.

2. The refractory structure as in claim 1, wherein the pre-formed refractory blocks are pressed or cast.

3. The refractory structure as in claim 1, wherein the bonding agent is a sacrificial or non-sacrificial bonding agent.

4. The refractory structure as in claim 1, wherein the bonding agent is an epoxy adhesive bonding agent.

5. The refractory structure as in claim 1, wherein the refractory modules comprise at least three of the preformed refractory blocks that are bonded to one another.

6. The refractory structure as in claim 1, further comprising a profiled tie plate positioned between adjacent vertically stacked refractory wall sections.

7. A method of forming the refractory structure according to claim 1, wherein the method comprises:

(i) forming a plurality of refractory wall sections by assembling end-to-end and stacking a plurality of the refractory modules such that the tooth of one module is received within and interlocked with the channel of an adjacent module; and thereafter (ii) adjacently stacking a plurality of the refractory wall sections to form the opposed side and end walls of the refractory wall structure.

8. The method as in claim 7, wherein the refractory blocks are pressed or cast.

9. The method as in claim 7, which comprises prior to step (i) the step of (ia) assembling the refractory modules by bonding multiple preformed square parallelepiped refractory blocks to one another with a bonding agent.

10. The method as in claim 9, wherein step (ia) comprises positioning adjacent refractory blocks in an off-set manner so as to form the tooth and channel arrangement of the refractory modules.

11. The method as in claim 9, wherein the bonding agent is a sacrificial or non-sacrificial bonding agent.

12. The method as in claim 11, wherein the bonding agent is an epoxy adhesive bonding agent.

* * * * *